United States Patent [19]

Fischer et al.

[11] 4,288,512

[45] Sep. 8, 1981

[54] METHOD OF MANUFACTURING LUMINESCENT SCREENS FOR COLOR PICTURE TUBES

[75] Inventors: Bruno Fischer; Rainer Vollath, both of Esslingen, Fed. Rep. of Germany

[73] Assignee: International Standard Electric Corporation, New York, N.Y.

[21] Appl. No.: 109,388

[22] Filed: Jan. 3, 1980

[30] Foreign Application Priority Data

Jan. 20, 1979 [DE] Fed. Rep. of Germany ..... 2902233

[51] Int. Cl.[3] ..... G03C 5/00

[52] U.S. Cl. ..... 430/24; 354/1; 430/4; 430/5; 430/26; 430/396; 430/494

[58] Field of Search ..... 430/24, 26, 394, 396, 430/494, 4, 5; 354/1; 355/84

[56] References Cited

U.S. PATENT DOCUMENTS

| | | | |
|---|---|---|---|
| 2,717,545 | 9/1955 | Engeler | 355/84 |
| 3,676,129 | 7/1972 | Ragland | 430/4 |
| 3,841,875 | 10/1974 | Park et al. | 430/24 |
| 4,001,018 | 1/1977 | Tsuneta et al. | 430/24 |
| 4,013,467 | 3/1977 | Hosokoshi et al. | 430/24 |

*Primary Examiner*—Edward C. Kimlin

*Attorney, Agent, or Firm*—John T. O'Halloran; Thomas N. Twomey

[57] ABSTRACT

A rotating diaphragm is used to distribute a predetermined amount of light onto a light-sensitive phosphor layer on a glass faceplate in order to obtain sharp-edged phosphor stripes.

2 Claims, 2 Drawing Figures

METHOD OF MANUFACTURING LUMINESCENT SCREENS FOR COLOR PICTURE TUBES

BACKGROUND OF THE INVENTION

1. Field of the Invention

The invention relates to a method of manufacturing luminescent screens for color-picture tubes, wherein a light-sensitive layer is exposed through the shadow mask of the tube.

2. Description of the Prior Art

In German Offenlegungsschrift (DE-OS) No. 24 40 575 stripes of phosphor are produced on a luminescent screen, which stripes vary in width within only narrow limits. A light-sensitive layer of luminescent material on a glass faceplate is exposed through a shadow mask to a light source. A light path is reproduced by a lens so as to correspond to the electron-beam path in the finished tube. On the screen, phosphor stripes of substantially constant width are to be achieved. However, the transmission of the mask varies considerably from the center toward the edge. In addition, the thickness and temperature of the light-sensitive layer of luminescent material applied in the screening process are dependent on screen position. For all these reasons, a filter is used which is located on, directly below, or directly above the lens. The filter influences the intensity of the light beams so that phosphor stripes of only slightly varying width are achieved. As a rule, the filter transmission at the edge is considerably higher than that at the center.

The filter usually consists of a gelatin-soot coating on glass. The production of such a coating is described in detail in DE-OS No. 20 36 684. If a screen is exposed through such a filter, phosphor stripes are obtained whose width stability is fully satisfactory but the edges of the stripes are rather frayed which, during the operation of the tube, gives rise to considerable hue errors in unfavorable cases, as in a uniform white picture.

The use of a rotating diaphragm along with a gelatin-soot filter to obtain position-dependent transmission of light is known (DE-OS No. 20 59 135).

SUMMARY OF THE INVENTION

The object of the invention is to provide a method of exposure with which sharp-edged phosphor stripes having only slight width variations can be achieved. This is achieved by changing the exposure level and causing the exposure time to vary from point to point instead of influencing the light intensity from point to point by means of a filter with unchanged exposure time, as has been common practice so far. In an embodiment, the method is implemented by placing a rotating diaphragm having a radially outwardly increasing aperture in the light path. A significant advantage of the method lies in the fact that the mechanical diaphragm keeps its transmission characteristic for an unlimited period of time, while soot-gelatin filters age quickly. Exposure time is shortened considerably by the method according to the invention; it is typically less than half that required with a method using a gelatin-soot filter.

The present invention shows that such a diaphragm can be used directly for the exposure of the light-sensitive phosphor layer without the use of a gelatin-soot filter and this results in a considerable improvement in stripe quality.

The above mentioned and other features and objectives of this invention will become more apparent by reference to the following description taken in conjunction with the accompanying drawing.

DESCRIPTION OF THE PREFERRED EMBODIMENT

Figure 1:
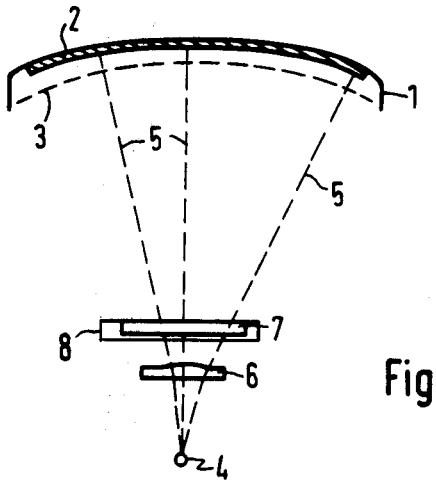
FIG. 1 is an illustration of the arrangement of the light source, lens, rotating diaphragm and glass faceplate.

Referring to FIG. 1, the glass faceplate 1 is a light-sensitive layer of luminescent material 2, which is exposed through the shadow mask 3 to the light source 4. The light beams are designated 5. The light path is reproduced by a lens 6 to correspond to the electron-beam path. A diaphragm 7 is rotated by a rotatable and drivable mount 8 (not completely shown).

Figure 2:
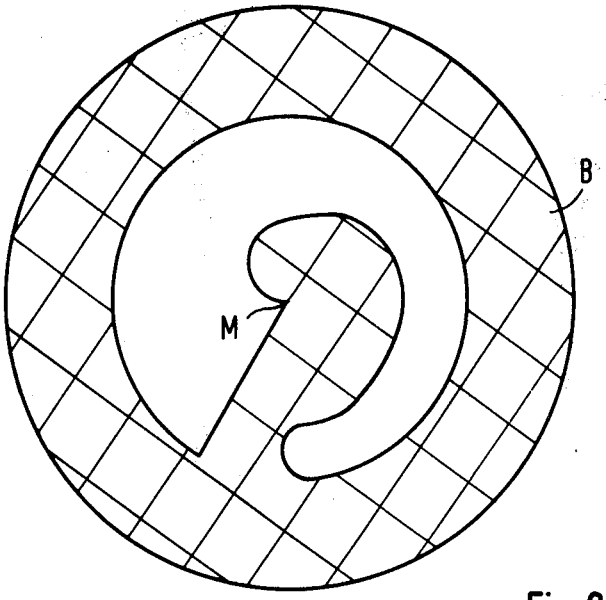
FIG. 2 is an illustration of the diaphragm showing the cut out area.

Referring to FIG. 2, the diaphragm B rotates about a point M, which lies on the axis of the central light ray. In the unhatched area, the light can pass through unhindered. The area cut out of the hatched material, preferably sheet steel, increases with increasing angle of rotation. As a result, during rotation of the diaphragm, the light at the center is highly attenuated on a time average, while toward the outside, the light rays are interrupted increasingly shorter, so that a greater amount of light passes through during the exposure time. The aperture is so designed that, on a time average, the position-dependent amount of light passing through corresponds to that passed by the conventional gelatin-soot filter.

If not only a radially symmetrical variation of the amount of light is required, it is, of course, possible to use, in addition to the rotating diaphragm according to the invention, a weak gelatin-soot correction filter or any other filter or an arrangement of diaphragms. The diaphragms are introduced into the light path at different points and for different periods of time (not shown).

The diaphragm is mounted in the light box ("lighthouse") at the point where the gelatin-soot filter was located. It is placed into a rotatable and drivable mount.

If a gelatin-soot filter is used, the light-sensitive layer of the green phosphor must be exposed for about 20 seconds to achieve phosphor stripes of the desired width and adhesion. With the method according to the invention, in the embodiment using a rotating diaphragm, the exposure time is only 10 seconds. The speed of the diaphragm is typically 100–200 revolutions per minute. Therefore during the 10 seconds, the diaphragm performs 17–33 revolutions.

While we have described above the principles of our invention in connection with specific apparatus, it is to be clearly understood that this description is made only by way of example and not as a limitation to the scope of our invention as set forth in the objects thereof and in the accompanying claims.

We claim:

1. A method of manufacturing luminescent screens for color-picture tubes comprising the steps of:

coating the faceplate with a light sensitive layer of luminescent material, exposing the faceplate to light through a shadow mask by means of a pencil of light rays from a light source, inserting a diaphragm having an aperture of radially increasing width in the path of said light rays, and rotating said diaphragm at a rate of approximately 100–200 revolutions per minute so that the amount of light reaching said faceplate increases from the center to the outside edge.

2. The method as claimed in claim 1 in which total exposure time is about 10 seconds.

* * * * *